US009121227B2

(12) United States Patent
Thommesen

(10) Patent No.: US 9,121,227 B2
(45) Date of Patent: Sep. 1, 2015

(54) TELESCOPIC RISER JOINT

(75) Inventor: Steingrim Thommesen, Oslo (NO)

(73) Assignee: Aker Oilfield Services Operation AS, Oslo (NO)

( * ) Notice: Subject to any disclaimer, the term of this patent is extended or adjusted under 35 U.S.C. 154(b) by 267 days.

(21) Appl. No.: 13/392,617

(22) PCT Filed: Sep. 2, 2010

(86) PCT No.: PCT/EP2010/062869

§ 371 (c)(1),
(2), (4) Date: Feb. 27, 2012

(87) PCT Pub. No.: WO2011/026897

PCT Pub. Date: Mar. 10, 2011

(65) Prior Publication Data

US 2012/0160508 A1 Jun. 28, 2012

(30) Foreign Application Priority Data

Sep. 2, 2009 (NO) ..... 20092934

(51) Int. Cl.
*E21B 17/01* (2006.01)
*E21B 17/07* (2006.01)

(52) U.S. Cl.
CPC ..... *E21B 17/01* (2013.01); *E21B 17/07* (2013.01)

(58) Field of Classification Search
CPC ..... E21B 17/085; E21B 17/06; E21B 19/10; E21B 17/01; E21B 17/07; B08B 1/008
USPC ..... 166/338–341, 355, 351–352, 358, 360, 166/367, 377–381
See application file for complete search history.

(56) References Cited

U.S. PATENT DOCUMENTS 3,465,817 A * 9/1969 Renic ..... 166/355
3,998,280 A * 12/1976 Kisling, III ..... 175/5
5,069,488 A * 12/1991 Freyer et al. ..... 285/302
5,184,681 A * 2/1993 Fontenot ..... 166/367
5,533,574 A 7/1996 Gonzalez (Continued)

FOREIGN PATENT DOCUMENTS

GB 2358032 A 7/2001
GB 2412130 A 9/2005

(Continued)

OTHER PUBLICATIONS

Schouten, Adri, "International Search Report" for PCT/EP2010/062869 as mailed May 11, 2011, 4 pages.

*Primary Examiner* — James G Sayre
(74) *Attorney, Agent, or Firm* — Winstead PC

(57) ABSTRACT

Telescoping riser arrangement forming part of a riser string (1) connecting a subsea well and a floating installation. The riser arrangement is adapted to be switched between a high pressure mode, in which an upper part of the riser assembly will move vertically with respect to the installation when the installation heaves, and a low pressure mode in which the upper part of the riser assembly will move vertically along with the installation when the installation heaves. In the low pressure mode, a low pressure inner sleeve (9) is adapted to reciprocate inside a high pressure outer sleeve (1*a*), the reciprocating heave path being above the position of the inner sleeve (9) in the high pressure mode. In the high pressure mode, the telescoping section of the low pressure inner sleeve (9) is enclosed within a high pressure compartment.

5 Claims, 4 Drawing Sheets

(56) References Cited

U.S. PATENT DOCUMENTS

Figure 1:
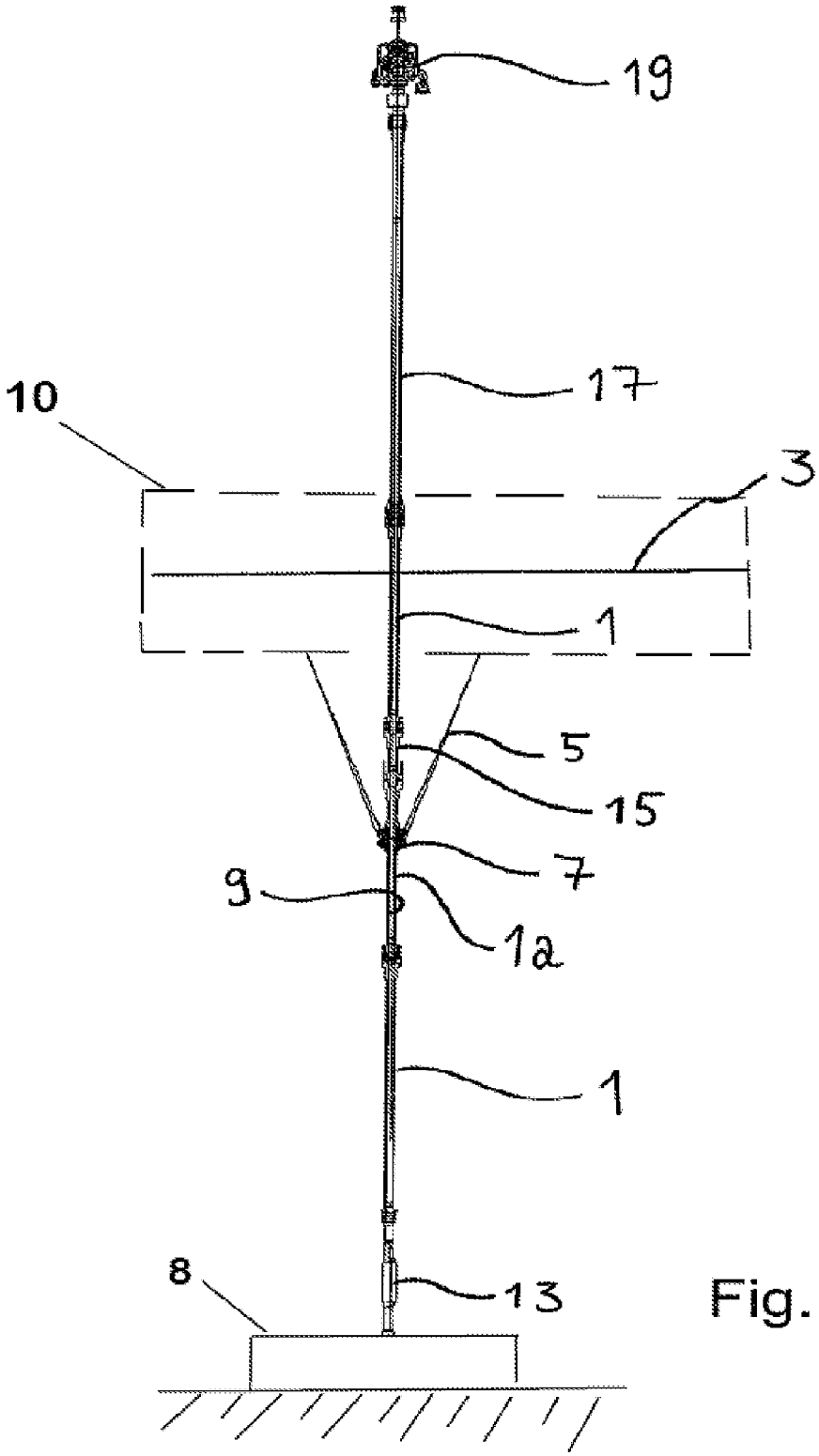

| | | | | |
|---|---|---|---|---|
| 6,173,781 | B1 * | 1/2001 | Milne et al. | 166/355 |
| 6,334,633 | B1 * | 1/2002 | Nguyen et al. | 285/320 |
| 8,210,264 | B2 * | 7/2012 | Mohr | 166/343 |
| 2002/0092653 | A1 * | 7/2002 | Scott et al. | 166/338 |
| 2003/0029621 | A1 * | 2/2003 | Haynes | 166/381 |
| 2008/0251257 | A1 | 10/2008 | Leuchtenberg | |

FOREIGN PATENT DOCUMENTS

| | | | |
|---|---|---|---|
| WO | WO-00/24998 | A1 | 5/2000 |
| WO | WO-03/067023 | A1 | 8/2003 |

* cited by examiner

TELESCOPIC RISER JOINT

The present invention relates to an arrangement for avoiding relative vertical movement between the upper end of a riser and a floating offshore installation during work on said upper end. More particularly the invention relates to a novel slip joint arrangement for a high pressure riser.

BACKGROUND

It is known to arrange heave compensators in the interface between a floating installation and a riser extending from the sea floor up to the installation. The heave compensator keeps the riser in the correct vertical position in the water while letting the floating installation move vertically with respect to the riser due to waves, swells, and tide. This is typically the case on a drilling riser (low pressure), while on an intervention riser (high pressure) such riser is typically running up to a flow tree in derrick. From the perspective of the personnel on the heaving floating installation, such intervention riser is moving up and down. Performing manual work on the top of the riser is therefore undesirably hazardous, as large movements and large forces are active. To do such work, it is known to suspend personnel to structures that are not moving with respect to the riser, so-called man-riding. This is only permitted in rather calm sea, thus limiting the time scopes for when such operations can be performed.

To avoid such working conditions, it is known to install a slip joint above the tension joint of the riser. With the slip joint in a telescoping mode, the upper part of the riser is fixed to the floating installation, preventing vertical movement between the installation and the upper part of the riser. Manual work can then be performed more safely.

Several publications describe such slip joints for use with intervention risers, one being international patent application publication WO 03067023 (Blakseth). This publication describes an arrangement for well completion and intervention operations where a workover riser (4) is projecting from a wellhead (6) and up to a vessel (2), and where the upper portion of the workover riser (4) is designed to be displaced from an upper position to a lowered position for rigging work. In this lowered position the upper displaceable portion of the riser (4) essentially follows the heave movements of the vessel. After the rigging work, the displaceable portion of the riser is again raised to the upper position, the riser being equipped with a telescoping connection (1). Before lowering the upper portion of the riser to the working position, pressure is relieved.

Publication WO 0024998 (Baker Hughes Incorporated) describes a pressurized slip joint for a marine intervention riser that decouples a flow head assembly in the moon pool of a vessel from the riser string to enable safe changeover of equipment during workover operations. One part of the slip joint assembly is coupled to the flow head assembly through a flexible joint assembly. A second part of the slip joint assembly supports the riser string and is coupled to the tensioning mechanism. The first part may be inserted into the second part and locked in place during workover operations, except when equipment changeover is taking place. The first and second parts have an unlocked and a locked mode. When in the unlocked mode, a low pressure seal is used, whereas a high pressure seal is used in the locked mode. When the first part is inserted into the second part, in the locked mode, a high pressure metal seal seals between the lower part of the first part and a shoulder inside the second part. Thus, the first part retains high pressure in this mode.

Common for the solutions described in these publications is that they consist of exactly the same building elements as a conventional telescopic joint used in all drilling risers. This is: an outer sleeve, an inner sleeve, inner sleeve running inside outer sleeve, a latch between inner and outer sleeve and seal arrangements between inner and outer sleeve. The main difference between above mentioned publications and such prior art drilling riser telescopic joint is that they are designed to withstand high pressure, not only low pressure as on a drilling riser telescopic joint.

The main functional difference between the two referenced publications is that WO 03067023 is in fully stroked out position when pressurized with high pressure and WO 0024998 is in fully retracted position when pressurized with high pressure.

Common for both WO 03067023 and WO 0024998 is further that both the inner and outer sleeves retains high pressure fluid when not telescoping (in the locked mode), whereas the pressure is relieved when in the telescoping mode. Thus, the inner telescoping pipe must be dimensioned to withstand such high pressure even though such pressure is not present when the inner pipe is fulfilling its main purpose, namely the telescoping action. Furthermore, the outer sleeve needs to be of a large dimension in order to accommodate the size of a high pressure inner sleeve. Thus, superfluous material is used resulting in increased weight and costs. And not at least, a very stiff riser is very disadvantageous with respect to the resulting high bending moment of the riser through rotary/work floor/moonpool and hence a stiff riser offers a very limited fatigue life of the riser. Both WO 03067023 and WO 0024998 includes both inner and outer barrels that will have to withstand either/or the full riser tension and internal high pressure.

The arrangement described in WO 03067023 exhibits still a further disadvantage, since the upper telescoping part must be in an upper position when in the non-telescoping or locked mode. This makes the upper part extend disadvantageously far up, making the necessary connections and connected devices, such as a surface flow tree, being arranged inconveniently high with respect to the floating installation. The slip joint will also be in extended mode when installing it, thereby requiring a large lifting height of the derrick.

THE INVENTION

The present invention provides a solution that overcomes the disadvantages of the prior art solutions.

According to the present invention there is provided a telescoping riser arrangement forming part of a riser string connecting a subsea well and a floating installation. The riser arrangement is adapted to be switched between a high pressure mode, in which an upper part of the riser assembly will move vertically with respect to the installation when the installation heaves, and a low pressure mode in which the upper part of the riser assembly will move vertically along with the installation when the installation heaves. According to the invention, in the low pressure mode, a low pressure inner sleeve is adapted to reciprocate inside a high pressure outer sleeve, wherein the reciprocating heave path is above the position of the inner sleeve in the high pressure mode. Furthermore, in the high pressure mode, the telescoping section of the low pressure inner sleeve is enclosed within a high pressure compartment.

The exact pressure values related to the terms "low pressure" and "high pressure" will depend on the specific embodiment of the invention, as will be appreciated by a person skilled in the art. In one particular embodiment, the pressure in the riser arrangement according to the invention can in the low pressure mode be below about 5 bar, whereas the pressure in the high pressure mode can be about 207 bar and above.

Having the telescoping section of the low pressure sleeve enclosed within a high pressure compartment when in the high pressure mode, makes it possible to use a low pressure sleeve with less material than known in the prior art. This is due to the fact that the inner sleeve will not have to withstand high pressure in the high pressure mode, since it is enclosed by the high pressure compartment. This is contrary to prior art solutions where the inner sleeve forms part of the high pressure confinement.

According to a preferred embodiment of the present invention, a seal is arranged between the inner sleeve and outer sleeve, Such a seal will maintain a water column inside the telescoping riser arrangement when in the telescoping low pressure mode. This will be further described below with reference to the drawings.

Furthermore, the riser arrangement preferably comprises a locking mechanism which is arranged and adapted to lock the outer sleeve to a high pressure element, which high pressure element moves with the inner sleeve in the low pressure telescoping mode. As will appear from the detailed example embodiment below, locking the high pressure sleeve to said high pressure element will enclose the inner (low pressure) sleeve inside a high pressure compartment.

The locking mechanism is preferably adapted to be actuated by means of a plurality of remotely operable hydraulic pistons. This makes it possible for the operator to lock and/or unlock the locking mechanism from a remote position.

In a special embodiment, the telescoping riser arrangement comprises a glide ring or wiper ring between the inner sleeve and the outer sleeve.

EXAMPLE OF EMBODIMENT

Figure 2A:
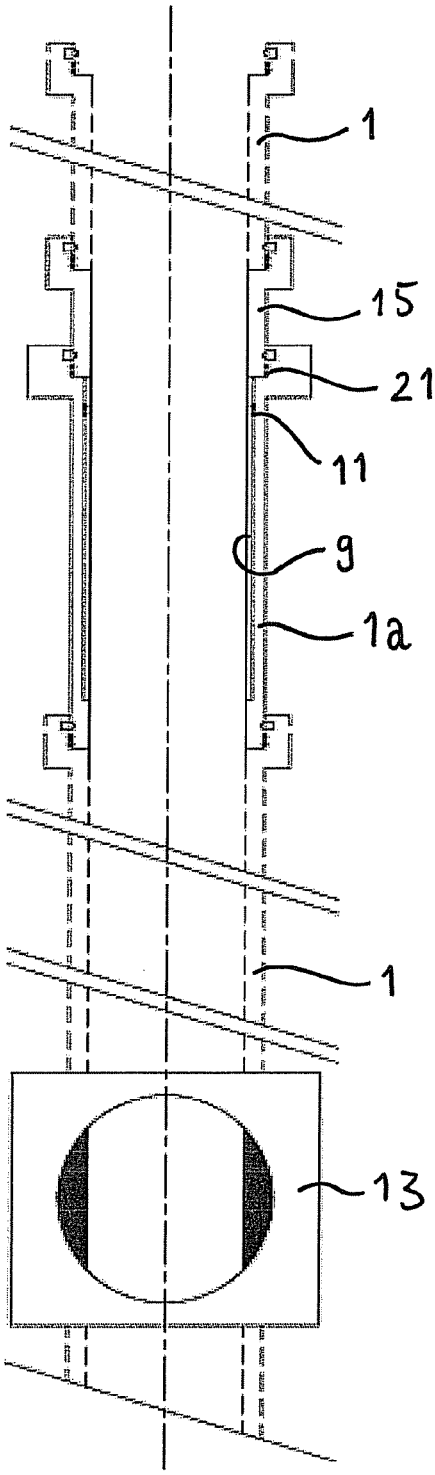
Figure 2B:
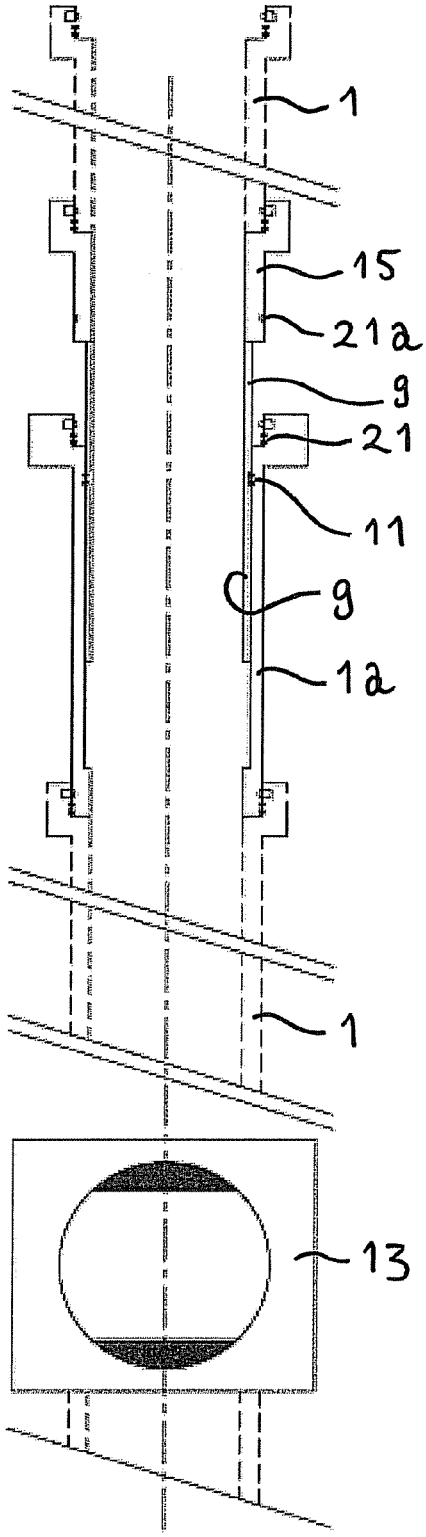
Figure 3:
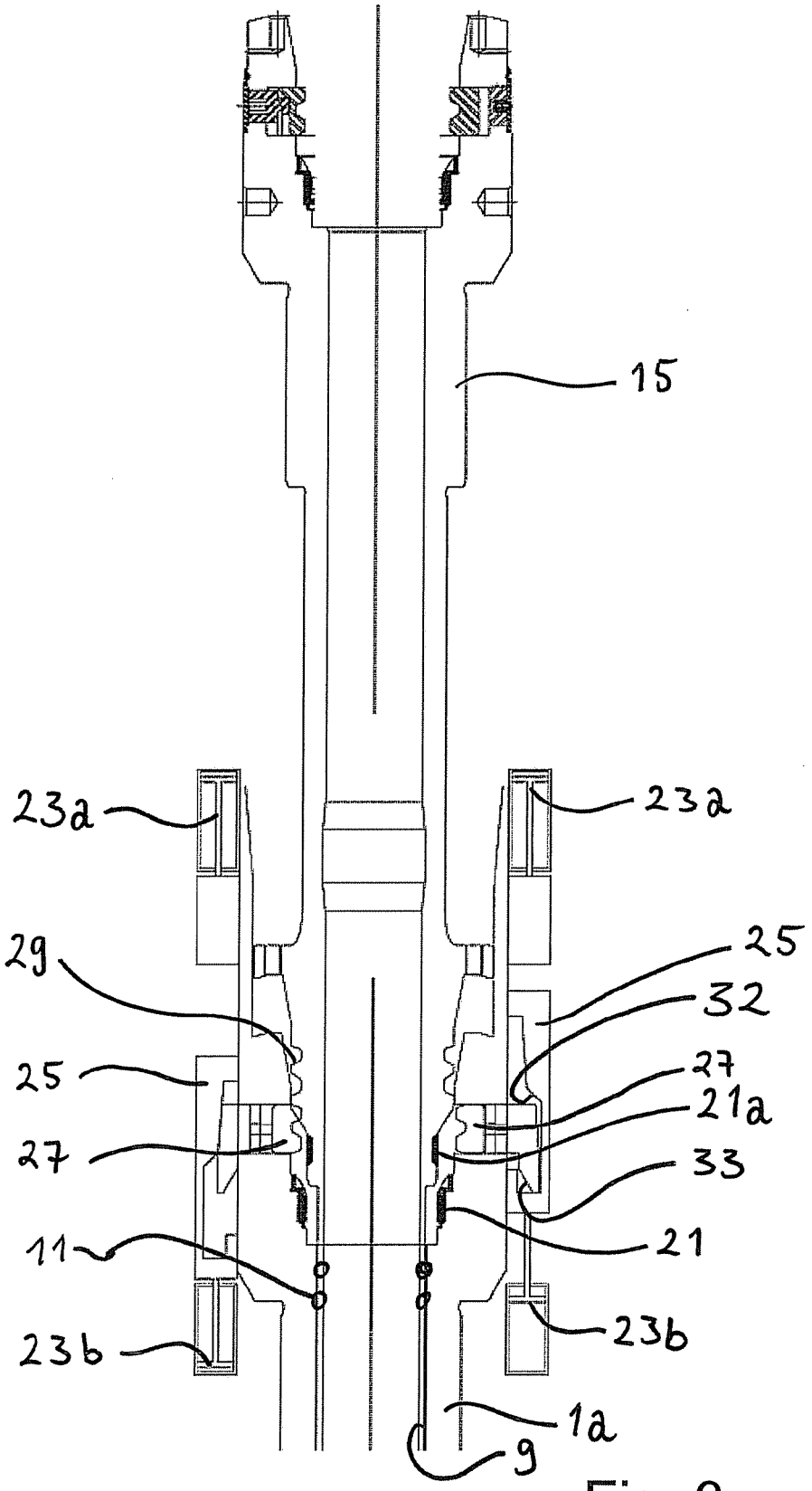
Figure 4:
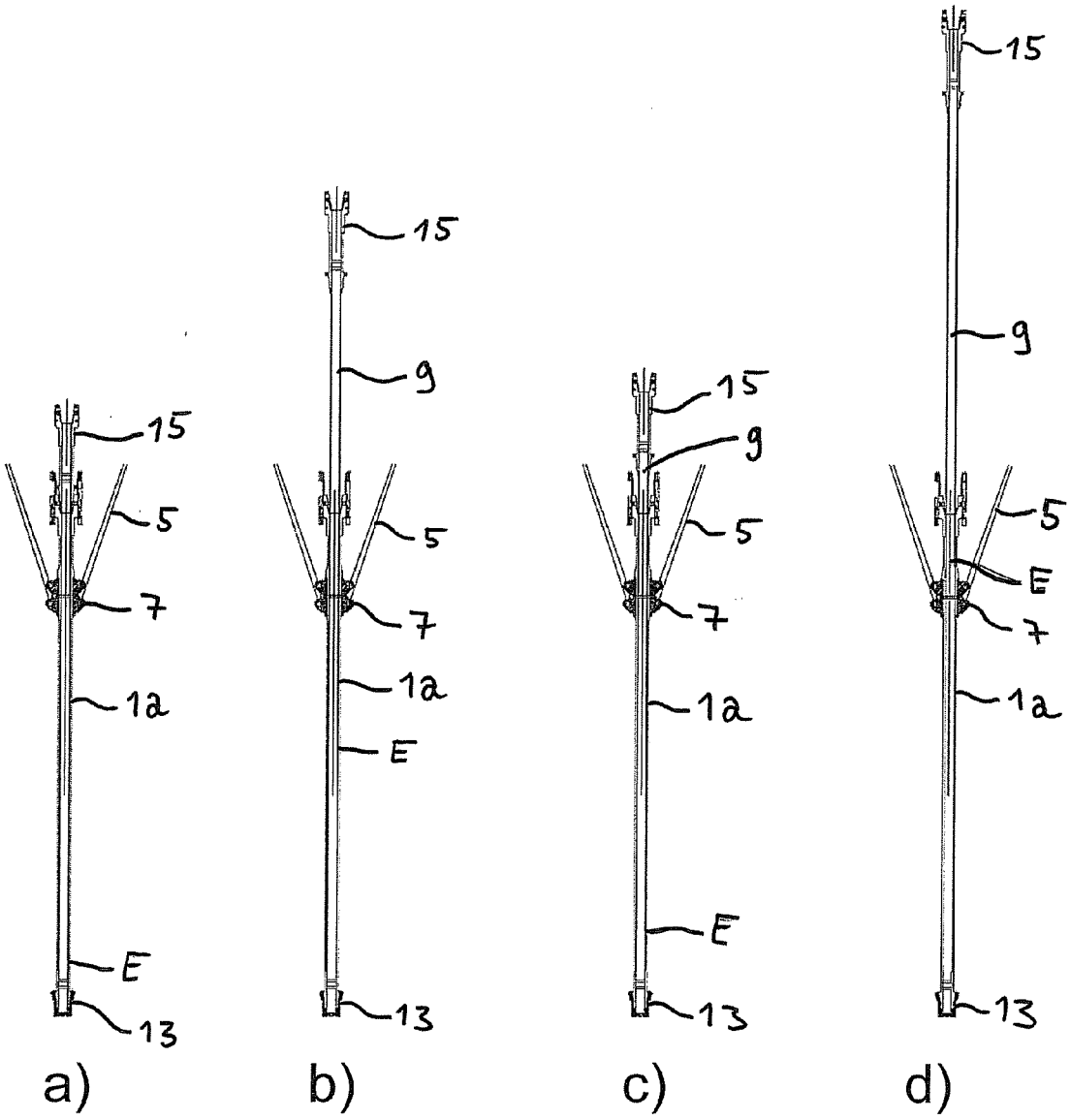

In order to illuminate the various advantages of the present invention and to give a more thorough understanding of it, a detailed description of an example embodiment is given in the following with reference to the drawings, in which FIG. 1 shows the setup of an arrangement according to the invention with the slip joint in a non-telescoping mode;

FIGS. 2*a* and 2*b* are principle sketches of the riser arrangement in a non-telescoping mode and in a telescoping mode, respectively;

FIG. 3 shows the sealing releasable connection arrangement of the riser arrangement according to the invention;

FIG. 4*a* shows the riser arrangement in a high pressure non-telescoping mode; and FIGS. 4*b* to 4*d* shows the riser arrangement in a low pressure telescoping mode, in nominal position, a full down stroke position, and a full up-stroke position, respectively.

In order to give a first overview of the riser arrangement according to the example embodiment of the present invention, it is referred to FIG. 1. This figure shows the setup of a riser 1 extending from a subsea well 8 to a floating installation 10 with a rotary table 3. The riser 1 is suspended to the installation through a set of tension wires 5 extending between the installation 10 and a tension ring 7 arranged to the riser 1.

Above the tension ring 7 a slip joint is arranged comprising an inner sleeve 9 that extends downwardly into an outer sleeve 1*a*. Since the arrangement is shown in a non-telescoping (high pressure) mode, the inner sleeve 9 is arranged within the outer sleeve 1*a* and is not appearing clearly in FIG. 1. As will be described further below, the inner sleeve 9 is a low pressure pipe. It will not retain the high pressures that may be present in the riser 1, which can be a high pressure riser.

When in the telescoping mode, the inner sleeve 9 reciprocates vertically within the outer sleeve 1*a*. In this mode the inner sleeve 9 moves vertically along with the heaving movements of the installation, as it is fixed to the installation, preferably through elements connected to its upper part.

To the outer surface of the lower portion of the inner sleeve 9 there is arranged a pair of low pressure seals 11, see FIGS. 2*a* and 2*b*, that seals against the inner surface of the riser 1. When the inner sleeve 9 reciprocates within the outer sleeve 1*a*, the low pressure seals 11 slide against the inner sleeve 9, constantly positioned to the inner surface of the outer sleeve 1*a*. The low pressure seals 11 thus prevent liquid in the inner sleeve 9 from exiting into the surrounding sea water.

In an alternative embodiment, a wiper ring or glide ring could be arranged instead of the seals 11. In such an embodiment there would be some fluid communication between the bore of the inner sleeve 9 and the surrounding sea. However, by adjusting the liquid level inside the riser arrangement to the level of the sea water, there will exist no pressure difference to cause any substantial amount of liquid flowing from the arrangement out into the sea or vice versa.

In the riser 1, at a position below the inner sleeve 9, there is arranged an isolating valve or a lubricator valve 13. In the telescoping mode, the lubricator valve 13 is closed, thereby isolating possible high pressures in the riser below it from the slip joint above it. In the non-telescoping mode, the lubricator valve 13 is open, transmitting possible high pressures to the slip joint.

Referring to FIG. 1, the upper part of the inner sleeve 9 is connected to a pipe utility piece (PUP) joint 15. Above the PUP joint 15 there is arranged a wear joint 17. On top of the wear joint 17 is arranged a surface flow tree 19 (SFT). More standard joints 1 may be used between the PUP joint 15 and the wear joint 17 for correct space-out if SFT versus tensioners.

In order to explain the principal function of the riser arrangement of the embodiment of the present invention in more detail, reference is again made to the principal sketches in FIGS. 2*a* and 2*b*. In FIG. 2*a*, a riser arrangement according to the present invention is shown in the non-telescoping mode. I.e. the upper part of the arrangement is moving vertically with respect to the floating installation when this heaves on the sea surface. In this mode, the lubricator valve 13 is open, transmitting high pressure from the riser portion below it.

The outer sleeve 1*a* is a high pressure pipe with a sealing connection to the riser part 1 below it. In FIG. 2*a*, one can see the inner sleeve 9 arranged within the outer sleeve 1*a* in a lower position (i.e. non-telescoping mode). The PUP joint 15, to which the upper part of the inner sleeve 9 is connected, is connected to the upper part of the outer sleeve 1*a* in a sealing manner by means of high pressure seals 21. Thus, in the non-telescoping mode shown in FIG. 2*a*, the inner sleeve 9 is not exposed to pressure differences between the inner bore and the ambient waters. It is protected within the high pressure compartment of the PUP joint 15 and the outer sleeve 1*a*. Thus, one will appreciate that the inner sleeve 9 is not mechanically challenged by pressures nor by riser tension in this non-telescoping mode.

When in the telescoping mode, however, as principally illustrated in FIG. 2*b*, the sealing connection between the outer sleeve 1*a* and the PUP joint 15 is broken. The PUP joint 15 is now elevated with regards to the outer sleeve 1*a*, and the inner sleeve 9 is reciprocating within the outer sleeve 1*a* as the floating surface installation heaves vertically. As mentioned above with reference to FIG. 1, a pair of low pressure seals 11 seal between the inner sleeve 9 and the outer sleeve 1*a*. Since the lubricator valve 13 is closed in the telescoping mode and the bore above it is vented, the pressure above the lubricator valve 13 is low. Thus, the inner sleeve 9 is not mechanically challenged by high pressures neither in the telescoping nor in the non-telescoping mode. Thus, it can be dimensioned accordingly.

In FIGS. 2*a* and 2*b*, the tension ring 7 is not indicated. In one embodiment it can be arranged in connection to the flange exterior to the high pressure seals 21, i.e. the flange at the upper part of the outer sleeve 1*a*.

Having described the principal function of the slip joint or telescoping joint of the embodiment of the riser arrangement according to the invention, a more genuine example of some of the elements will now be explained with reference to FIG. 3.

In the present embodiment of the invention, the PUP joint 15 and the outer sleeve 1*a* can be connected and disconnected, respectively, by means of hydraulic actuators. In FIG. 3, two connecting pistons 23*a* and two disconnecting hydraulic pistons 23*b* are shown. As will be appreciated by a person skilled in the art when studying FIG. 3, the two upper pistons in the drawing are the connecting hydraulic pistons 23*a*. Furthermore, the number of hydraulic pistons can be more or even less than shown in FIG. 3. Arranging a plurality of pistons for each function will elevate operational reliability, as the desired function may be carried out with the remaining pistons even if one or some pistons are malfunctioning. When actuating the connecting hydraulic pistons 23*a* downwards by appropriate application of hydraulic pressure, they will move a connection collar 25 axially downwards. The connection collar 25 extends circumferentially about the inner parts. However, in order to show the connection collar 25 in the connected and disconnected position, it is indicated in the upper, disconnected position on the right hand side, and in the lower connected position on the left hand side of the drawing. When the connection collar 25 is forced downwards by means of the connecting hydraulic pistons 23*a*, it will force a plurality of dogs 27 radially inwards. The dogs 27 are provided with locking grooves that are adapted to mate with locking grooves 29 provided on the exterior surface of the lower part of the PUP joint 15. The dogs 27 are forced radially inwards by an inclined face 31 of the connection collar exerting force on the radially outer part of the dogs 27. As can be appreciated, the locking grooves 29 on the lower part of the PUP joint 15 are shown vertically above the dogs 27, thus not in the vertically correct position for a connection. When connecting, the dogs 27 face the locking grooves 29.

When disconnecting, the connection collar 25 is moved axially upwards by corresponding disconnecting hydraulic pistons 23*b*. In a similar fashion to the connection step, the dogs 27 are moved out of engagement with the locking grooves 29 when the connection collar 25 engages an inclined face 33 of the dogs 27.

The connecting and disconnecting hydraulic pistons 23*a*, 23*b* can be adapted to be remotely actuated by the operator.

In FIG. 3, a high pressure seal 21 can be seen arranged to the inner bore of the upper connecting part of the outer sleeve 1*a*. The lower part of the PUP joint 15 exhibits an oppositely facing sealing surface 21*a* adapted to abut against the seal 21 when in the non-telescoping mode (refer FIG. 2*a*).

The upper part of the PUP joint 15 is connected to the riser wear joint 17 or to additional riser joints 1 between PUP joint and wear joint.

It should be clear to a person skilled in the art that the pipe segment with sealing connection to the upper part of the outer sleeve 1*a* does not have to be a PUP joint 15 as described herein. Another element fulfilling the need for sealing against the outer sleeve 1*a* can also be arranged. For instance, the outer sleeve 1*a* could be connected to the lower part of the wear joint 17. Moreover, instead of being suspended in the PUP joint 15 (or the corresponding sealing element), the inner sleeve 9 can also be suspended in a pipe segment above the PUP joint 15, or, in theory, within the PUP joint 15 (or corresponding element). The inner sleeve is connected to the PUP joint (or corresponding element) by means of welding, threading or bolting.

FIGS. 4*a*-4*d* show the riser arrangement in various positions. In FIG. 4*a*, the riser arrangement is in the non-telescoping mode, wherein the PUP joint 15 is connected to the outer sleeve 1*a*. The marker E indicates the lower position of the inner sleeve 9 inside the outer sleeve 1*a*. As can be seen, the position E in FIG. 4*a* indicates the lowest possible position of the inner sleeve 9.

In FIG. 4*b*, the riser arrangement is in a telescoping, low pressure mode and in a nominal position. In this position, the lower end of the inner sleeve 9 is in an intermediate position E. FIGS. 4*c* and 4*d* show the inner sleeve 9 in a full down-stroke position and a full up-stroke position, respectively. The various vertical positions of the PUP joint 15 in FIGS. 4*b*-4*d* indicate the vertical heaving position of the floating installation to which the PUP joint 15 vertically fixed.

The invention claimed is:

1. A telescoping riser arrangement forming part of a riser string connecting a subsea well and a floating installation, the riser arrangement being adapted to be switched between a non-telescoping high pressure mode, in which an upper part of the riser arrangement will move vertically with respect to the floating installation when the floating installation heaves, and a telescoping low pressure mode, in which the upper part of the riser arrangement will move vertically along with the floating installation when the floating installation heaves, wherein:

in the telescoping low pressure mode, an inner sleeve is adapted to reciprocate with respect to an outer sleeve and with a lower end inside the outer sleeve, the reciprocating heave path being above a position of the inner sleeve in the non-telescoping mode; and in the non-telescoping high pressure mode, the inner sleeve is enclosed within the outer sleeve and the entire inner sleeve is arranged within a high pressure compartment constituted by the outer sleeve, a high pressure seal, and the riser string and wherein the high pressure compartment is not constituted by the inner sleeve.

2. The telescoping riser arrangement according to claim 1, wherein a low pressure seal is arranged between the inner sleeve and the outer sleeve.

3. The telescoping riser arrangement according to claim 1, wherein an upper part of the inner sleeve is connected to a pipe utility piece joint and that a locking mechanism is arranged and adapted to lock the outer sleeve to the pipe utility piece joint.

4. The telescoping riser arrangement according to claim 3, wherein the locking mechanism is adapted to be actuated by means of a plurality of remotely operable hydraulic pistons.

5. The telescoping riser arrangement according to claim 1, wherein the telescoping riser arrangement comprises a glide ring or wiper ring between the inner sleeve and the outer sleeve.

* * * * *